US007464815B2

(12) United States Patent
Wojcik

(10) Patent No.: US 7,464,815 B2
(45) Date of Patent: Dec. 16, 2008

(54) FLEXIBLE PACKAGE FOR CUTTING BLADES

(75) Inventor: Frank A. Wojcik, Toledo, OH (US)

(73) Assignee: Crescent Manufacturing Company, Fremont, OH (US)

( * ) Notice: Subject to any disclaimer, the term of this patent is extended or adjusted under 35 U.S.C. 154(b) by 364 days.

(21) Appl. No.: 11/386,387

(22) Filed: Mar. 22, 2006

(65) Prior Publication Data

US 2007/0221527 A1 Sep. 27, 2007

(51) Int. Cl.
*B65D 85/20* (2006.01)
*B65D 73/00* (2006.01)
*B65B 5/10* (2006.01)

(52) U.S. Cl. ..... 206/372; 206/460; 206/484; 206/813; 53/475

(58) Field of Classification Search ..... 206/349–372, 206/460, 484–484.2, 813, 820; 383/38–39; 53/416, 473, 475
See application file for complete search history.

(56) References Cited

U.S. PATENT DOCUMENTS 1,489,379 A * 4/1924 Zeller ..... 206/820
1,619,081 A * 3/1927 Mclaurin ..... 206/813
2,744,624 A * 5/1956 Hoogstoel et al. ..... 206/460
2,866,542 A * 12/1958 Svirchev ..... 206/363
3,047,139 A * 7/1962 Jacoff ..... 206/372
3,469,768 A * 9/1969 Repko ..... 206/484
3,534,887 A * 10/1970 Ginsberg ..... 206/484.2
3,597,302 A * 8/1971 Gerard ..... 206/484.2
4,201,297 A * 5/1980 Datwyler ..... 206/349
2001/0007926 A1 * 7/2001 Trudil ..... 206/363

* cited by examiner

*Primary Examiner*—Bryon P Gehman
(74) *Attorney, Agent, or Firm*—James R. Eley; Michael A. Forhan; Eley Law Firm Co.

(57) ABSTRACT

A flexible package comprises first and second flexible layers having substrates with groups of longitudinal spaced-apart adhesive strips disposed thereupon. The groups of adhesive strips are generally aligned with each other and joined together to form a plurality of generally monolithic longitudinal spaced-apart seal strips. A first transverse heat seal is formed along a first edge defined by the first and second flexible layers. A second transverse heat seal is formed along a second, opposing edge defined by the first and second flexible layers. At least one series of longitudinal perforations bisect at least one seal strip, and at least one series of transverse perforations are oriented generally parallel to and proximate one of the first and second heat seal. One or more objects are detachably and releasably contained by the package, the objects being disposed between the first and second flexible layers and located between the seal strips.

22 Claims, 7 Drawing Sheets

FLEXIBLE PACKAGE FOR CUTTING BLADES

FIELD

The present invention relates generally to cutting blades, in particular a package for storing and handling cutting blades.

BACKGROUND

In the meat-processing industry the productivity and overall yield of a meat-processing plant depends on a number of factors, including the efficiency of the equipment being used, particularly the sharpness of the blades utilized to cut the meat. The cutting blades have a tendency to wear after being used for a period of time, making it necessary to regularly replace them in order to maintain the desired productivity and yield. Meat cutting equipment is typically designed to utilize cutting blades that can be quickly removed and replaced with new ones as the need arises.

A meat processing plant will usually keep a number of new blades on hand in order to facilitate their rapid replacement in the cutting equipment as they dull. The processing plant will also typically have a number of used blades that must be stored or disposed of in a safe manner. Storing and handling both new and used cutting blades can be problematic, since they pose a safety risk to workers due to their sharpness.

It is also important to store and handle new cutting blades so that they are not contaminated by incidental contact with inappropriate materials, since the blades are intended for use in food processing. A further concern is that contact of the blades with certain contaminants may cause premature blade wear or failure.

Accordingly, there is a need for a way to package newly-manufactured cutting blades so that they can be safely handled with little or no damage or contamination. There is a further need for a way to package used cutting blades for handling and storage.

SUMMARY

The present invention is a combination hot and cold seal package for cutting blades that comprises a first flexible layer having a substrate that includes an aqueous-based acrylic adhesive that is applied in a pattern of spaced-apart strips. A second flexible layer likewise includes a substrate having an aqueous-based acrylic adhesive that is applied to the film in a pattern corresponding to that of the first layer. The first and second layers are assembled such that the strips of the first and second layers are aligned with each other. Pressure is applied to the aligned assembly, causing the adhesive strips to bond together. Spaces between the strips define adhesive-free pockets for retaining cutting blades. A heat seal is applied to the packaging along edges transverse to the strips, sealing off open ends of the pockets. Perforations are provided in the packaging, generally bisecting the interior adhesive strips. The perforations allow select portions of the package to be opened and the blades to be dispensed individually.

An aspect of the present invention is a flexible package. The flexible package comprises a first flexible layer having a first substrate with a first group of longitudinal spaced-apart adhesive strips disposed thereupon and a second flexible layer having a second substrate with a second group of longitudinal spaced-apart adhesive strips disposed thereupon. The second group of adhesive strips are generally aligned with and joined to the first group of adhesive strips to form a plurality of generally monolithic longitudinal spaced-apart seal strips. A first transverse heat seal is formed along a first edge defined by the first and second flexible layers, and a second transverse heat seal formed along a second, opposing edge defined by the first and second flexible layers. At least one series of longitudinal perforations bisect at least one seal strip, and at least one series of transverse perforations are oriented generally parallel to and proximate one of the first and second heat seal. One or more objects are detachably and releasably retained by the package, the objects being disposed and retained between the first and second flexible layers and located between the seal strips.

Another aspect of the present invention is a method for packaging objects. The method comprises the steps of applying a first group of longitudinal spaced-apart adhesive strips to a first substrate to form a first flexible layer and applying a second group of longitudinal spaced-apart adhesive strips to a second substrate to form a second flexible layer. Objects to be packaged are placed upon the first substrate, in void areas between the first group of adhesive strips. The first and second groups of spaced-apart adhesive strips are aligned with each other and joined together to form a plurality of generally monolithic longitudinal spaced-apart seal strips. A first transverse heat seal is formed along a first edge defined by the first and second flexible layers. A second transverse heat seal is formed along a second, opposing edge defined by the first and second flexible layers. At least one seal strip is bisected with a series of longitudinal perforations, and at least one series of transverse perforations are made that are oriented generally parallel to and proximate one of the first and second heat seal. The objects are detachably and releasably contained by the package, the objects being disposed and retained between the first and second flexible layers and located in void areas between the seal strips.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1A:
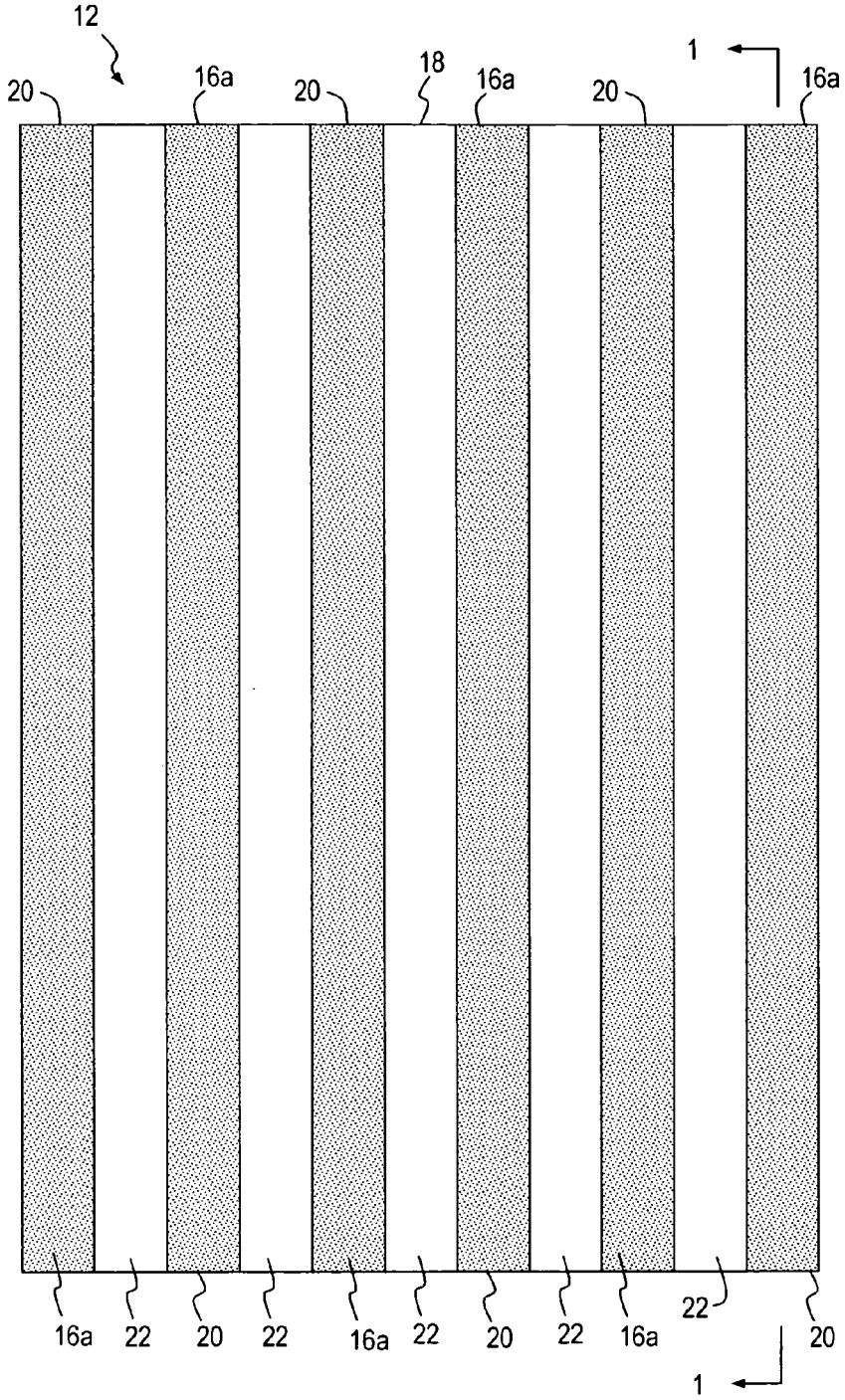
FIG. 1A is a top plan view of a first layer of a flexible package according to an embodiment of the present invention.
Figure 1B:
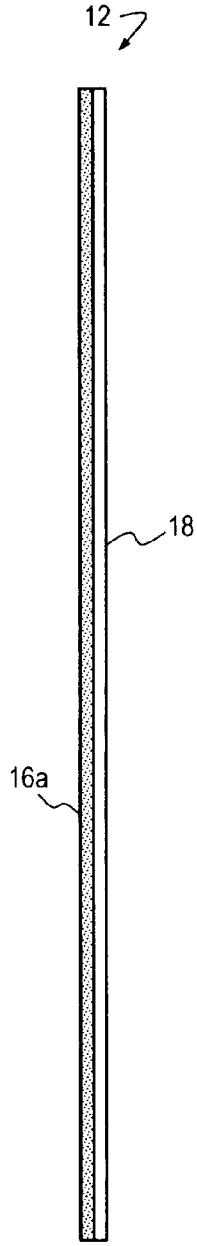
FIG. 1B is a view in section of the first layer of FIG. 1A.
Figure 2A:
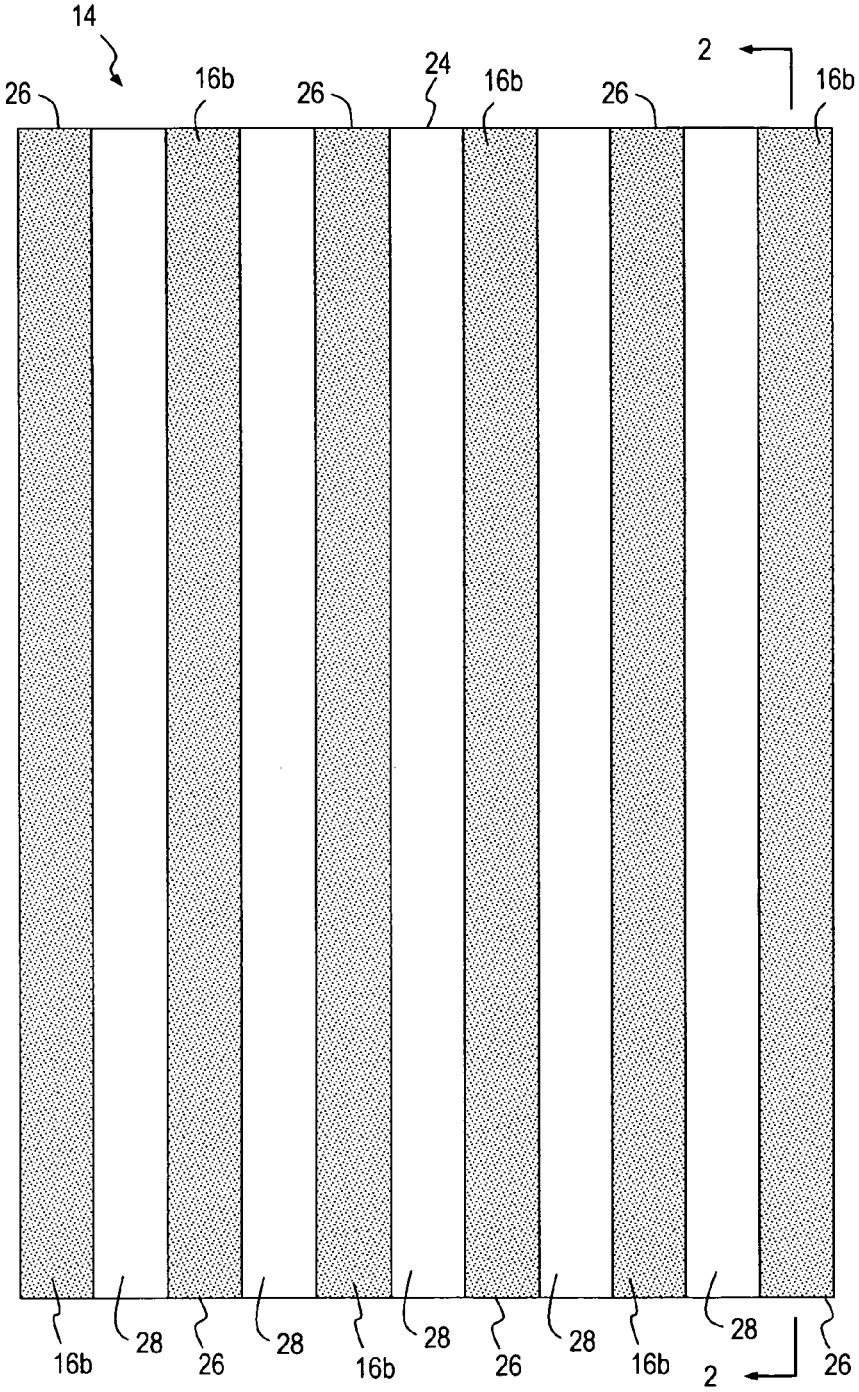
FIG. 2A is a top plan view of a second layer of a flexible package according to an embodiment of the present invention.
Figure 2B:
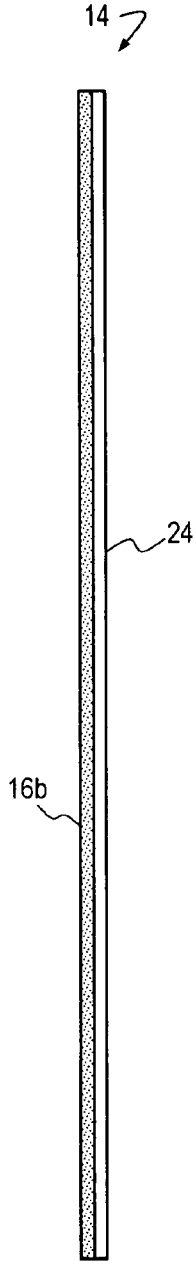
FIG. 2B is a view in section of the second layer of FIG. 2A.
Figure 3:
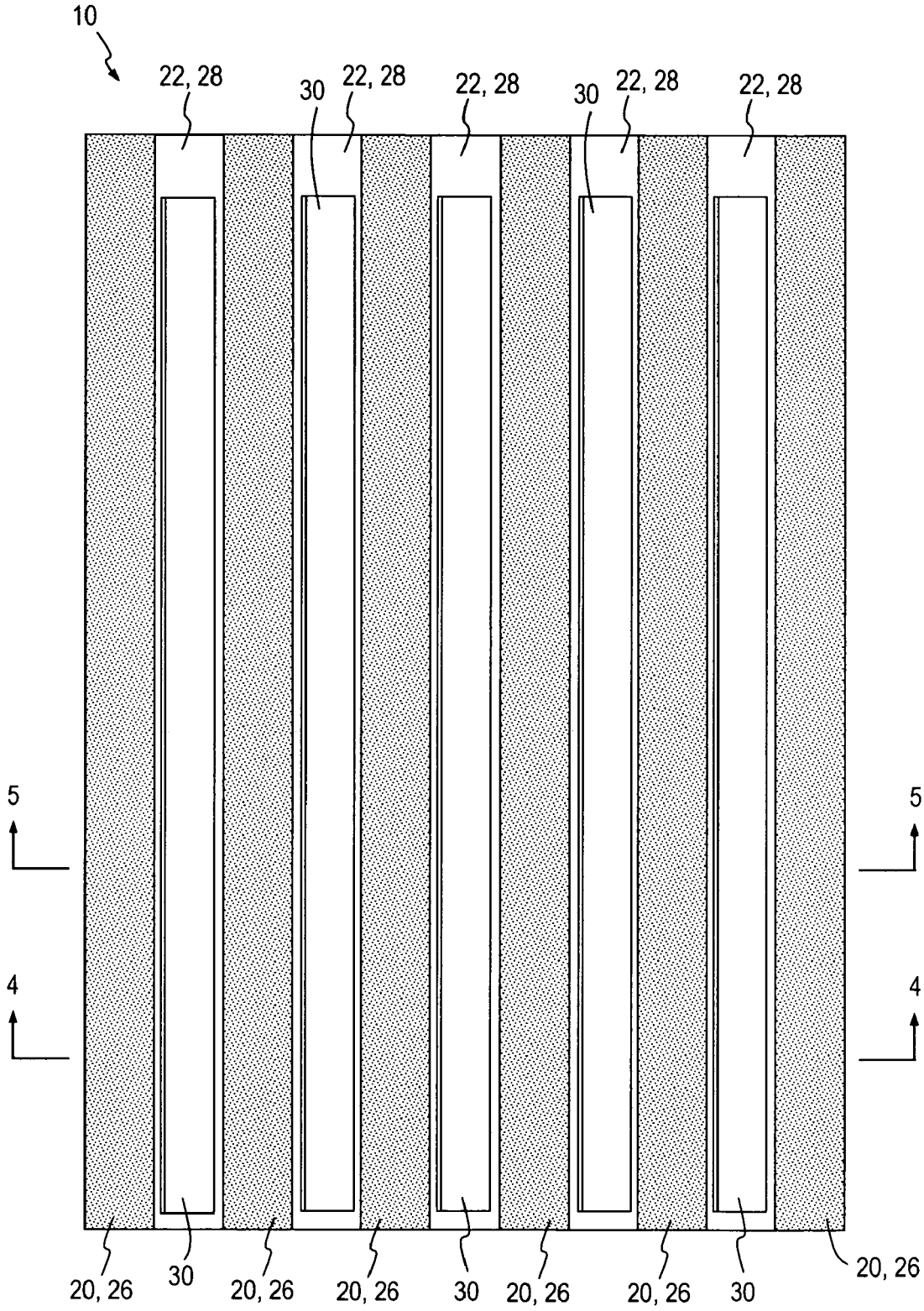
FIG. 3 is a top plan view showing the assembly of the first and second layers of a flexible package according to an embodiment of the present invention and containing blades.
Figure 4:
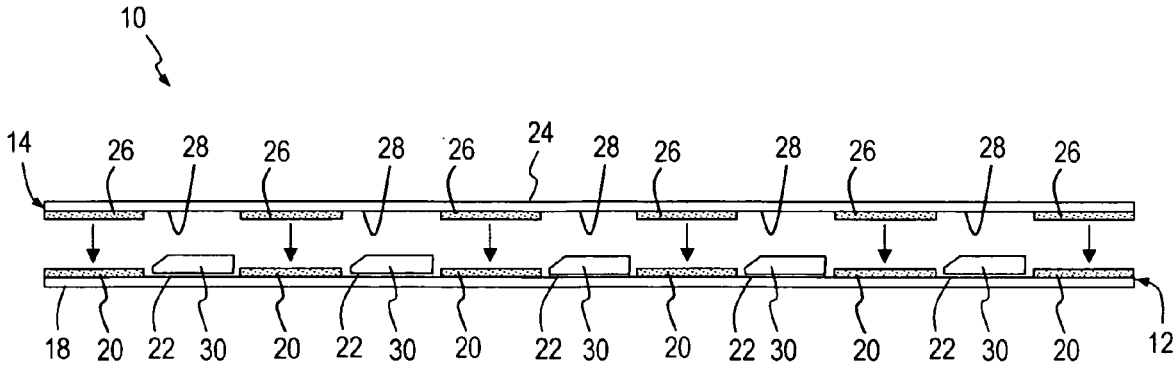
FIG. 4 is a view in section of the stack-up of the assembly of FIG. 3 and containing blades.

Referring to FIGS. 1A, 1B, 2A and 2B a flexible package for cutting blades comprises a first flexible layer 12 and a second flexible layer 14. First layer 12 includes an adhesive 16*a* that is selectively applied to a substrate 18 in a pattern of longitudinal spaced-apart adhesive strips 20 and voids 22 containing no adhesive. Second layer 14 similarly includes an adhesive 16*b* that is selectively applied to a substrate 24 in a pattern of longitudinal spaced-apart adhesive strips 26 and voids 28 containing no adhesive, as shown in FIGS. 2A and 2B.

Substrates 18, 24 may be any suitable flexible material, such as polypropylene, polyethylene and polyester. In one embodiment a low density polyethylene (LDPE) about 0.005 inches thick is utilized for substrates 18, 24. Substrates 18, 24 may be clear or opaque.

Adhesive 16*a*, 16*b* may be any cold seal adhesive of suitable thickness that adheres to substrates 18, 24 and exhibits suitable cohesive properties. Cold seal cohesive adhesive 16*a*, 16*b* is configured to seal with pressure alone. Accordingly, when cohesive adhesives 16*a* and 16*b* come into contact with each other they will adhere to one another, forming a seal. In one embodiment adhesive 16*a*, 16*b* is an aqueous-based acrylic adhesive about 0.0003 to 0.001 inches thick. Adhesive 16*a*, 16*b* may be selectively applied to substrates 18, 24 to form adhesive strips 20, 26 by any conventional process, including screen printing, spraying, blade coating and roll-coating. In one embodiment of the present invention adhesive strips 20, 26 are each applied continuously along the length of corresponding rolls of substrates 18, 24 respectively, the first and second layers 12, 14 respectively each being cut to a predetermined length.

Figure 5:
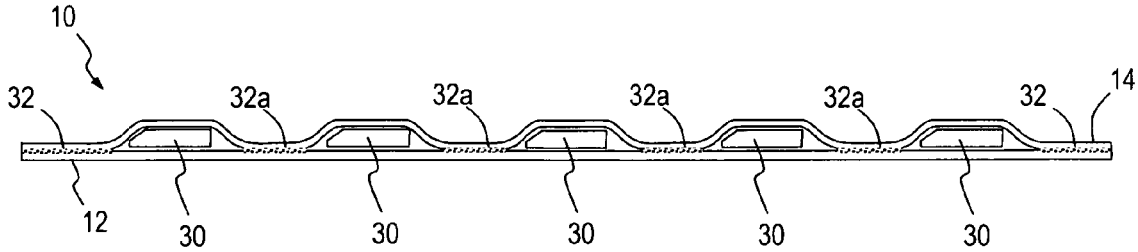
FIG. 5 is a view in section of the assembly of FIGS. 3 and 4 after assembly of top and bottom layers together and containing blades.
Figure 6A:
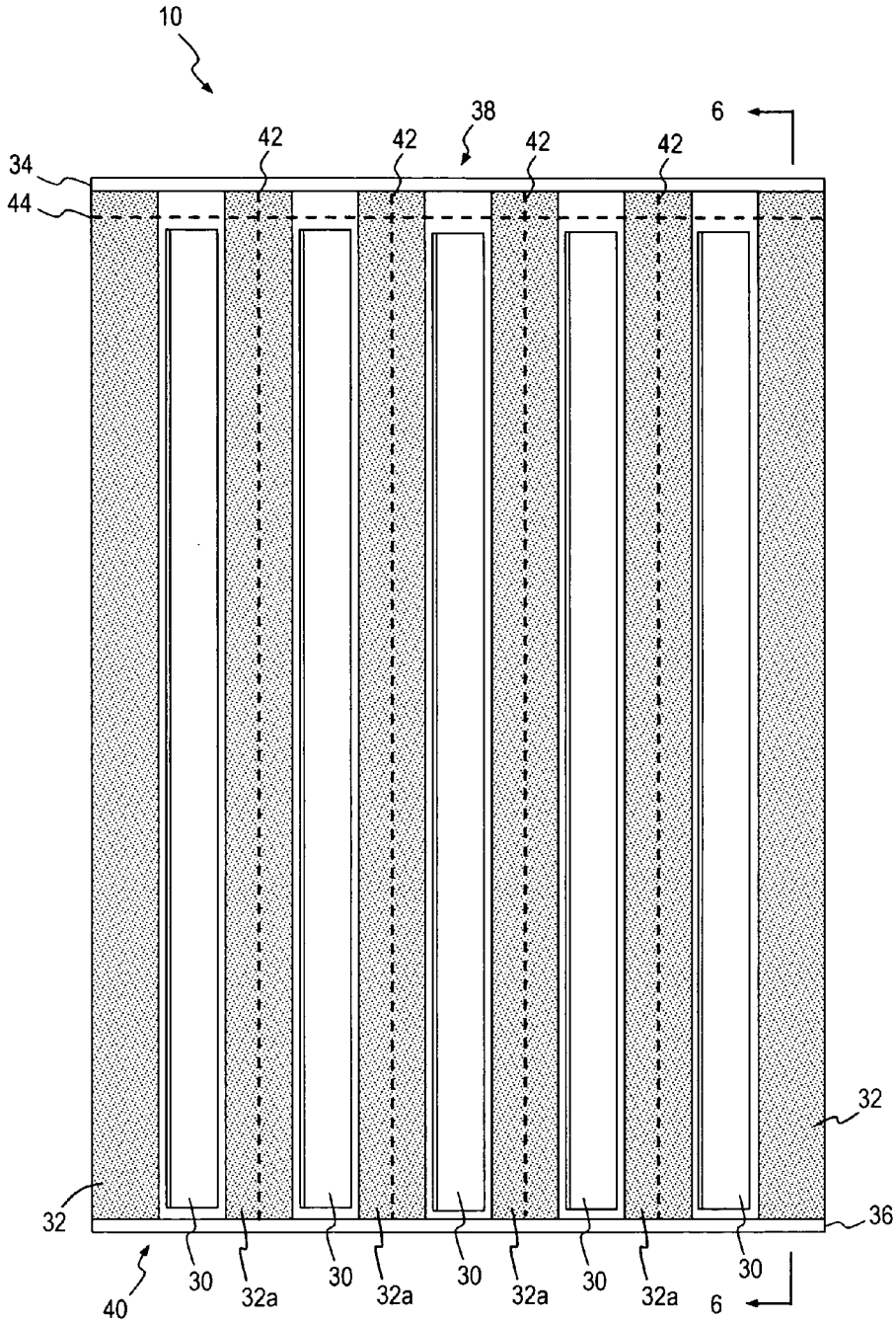
FIG. 6A is a top plan view of a completed flexible package according to an embodiment of the present invention and containing blades.
Figure 6B:
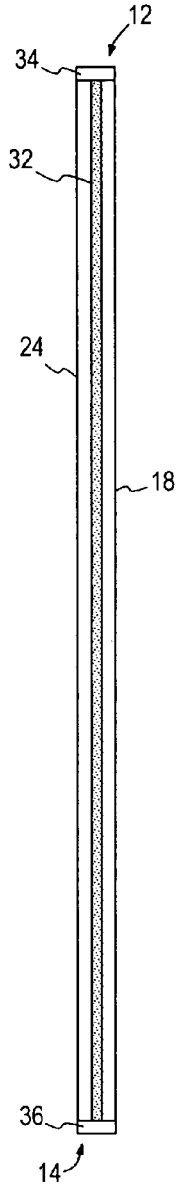
FIG. 6B is a view in section of the completed flexible package of FIG. 6A.

With reference to FIGS. 1A, 2A, 3 and 4, a flexible package 10 is assembled by placing one or more objects to be packaged, such as cutting blades 30, atop first layer 12 in voids 22 between adhesive strips 20. Cutting blades 30 are positioned so as to avoid contact with adhesive strips 20. Second layer 14 is oriented atop first layer 12 such that corresponding adhesive strips 20, 26 and voids 22, 28 of the first and second layers are generally aligned with each other. Pressure is applied to the assembly, causing adhesive strips 20, 26 to bond and join together to form generally monolithic longitudinal seal strips 32, 32*a* as shown in FIGS. 5, 6A and 6B. As previously noted, adhesive strips 20, 26 comprise cohesive adhesives 16*a*, 16*b* respectively which are configured to cold-seal using applied pressure alone. Accordingly, when cohesives 16*a* and 16*b* come into contact with each other they will adhere to one another, thereby forming monolithic seal strips 32, 32*a*.

With reference now to FIGS. 6A and 6B, after first and second layers 12, 14 are bonded together and the product to be packaged 30 is in place a first transverse heat seal 34 and a second transverse heat seal 36 are formed to complete sealing of package 10. First and second heat seals 34, 36 are formed by applying localized heat and pressure to a first end 38 and second end 40, respectively, the localized heat and pressure causing first and second substrates 18, 24 to substantially melt together. A series of longitudinal perforations 42 are made in package 10, generally bisecting the interior longitudinal seal strips 32*a*. Likewise, a series of transverse perforations 44 are made proximate and generally parallel to first and/or second heat seals 34, 36.

Figure 7:
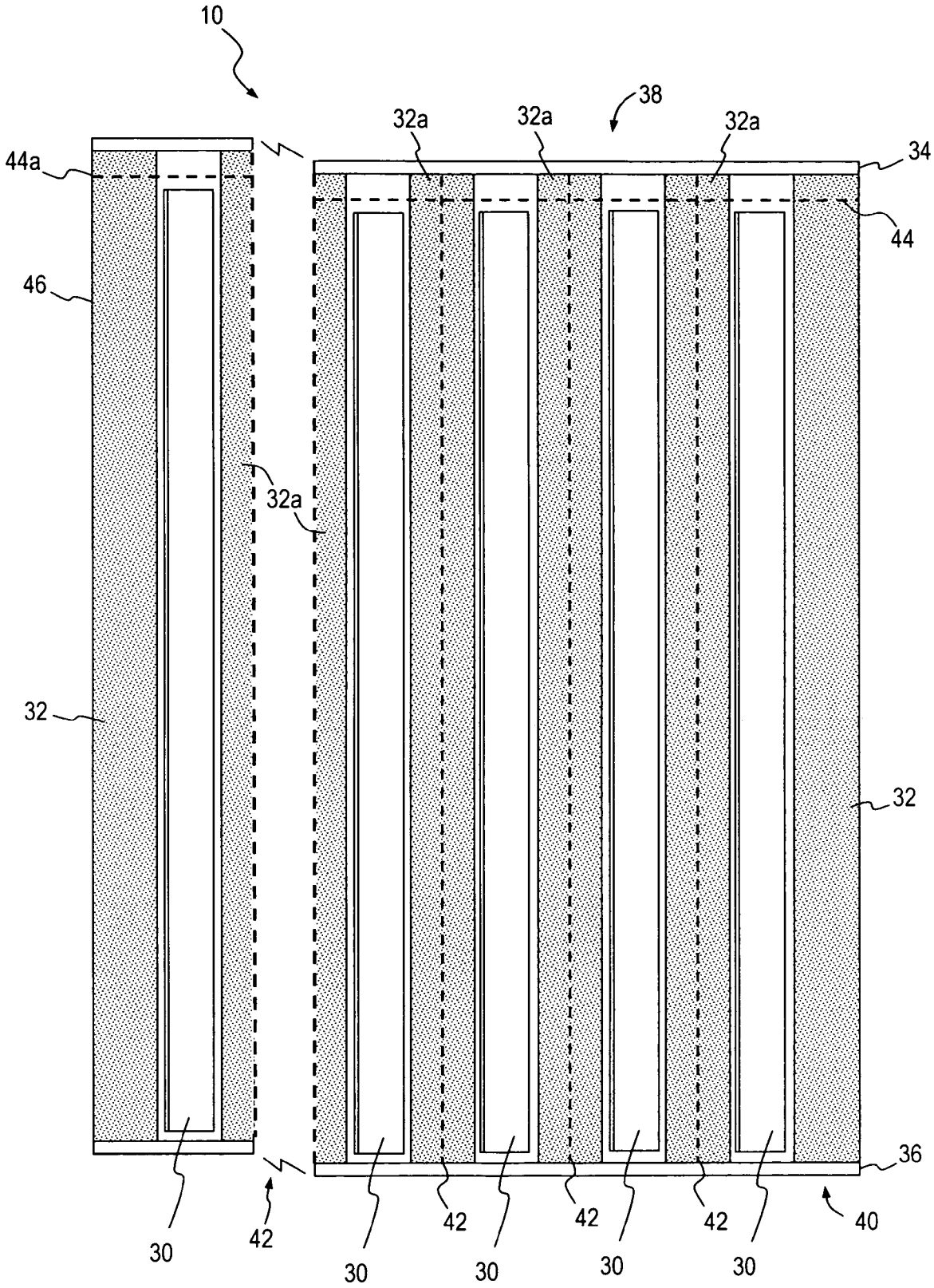
FIG. 7 depicts a flexible package in use, according to an embodiment of the present invention.

In use, package 10 protects cutting blades 30 from environmental contamination or damage during handling while protecting a user from injury due to contact with the blades. When a cutting blade 30 is needed, the user separates a portion of package 10 along a selected series of longitudinal perforations 42, detaching a selected number of blades from the package as shown in FIG. 7 to form a sub-package 46 that continues to protect the blade and the user from harm. When cutting blade 30 of sub-package 46 is to be installed into a meat cutting apparatus (not shown), the user simply tears the sub-package 46 along transverse perforations 44*a*, releasably exposing the blade and allowing it to be easily removed from sub-package 46 through the opening formed therefrom. Additional sub-packages 46 may be formed as desired by tearing package 10 along the remaining longitudinal perforations 42.

Figure 8:
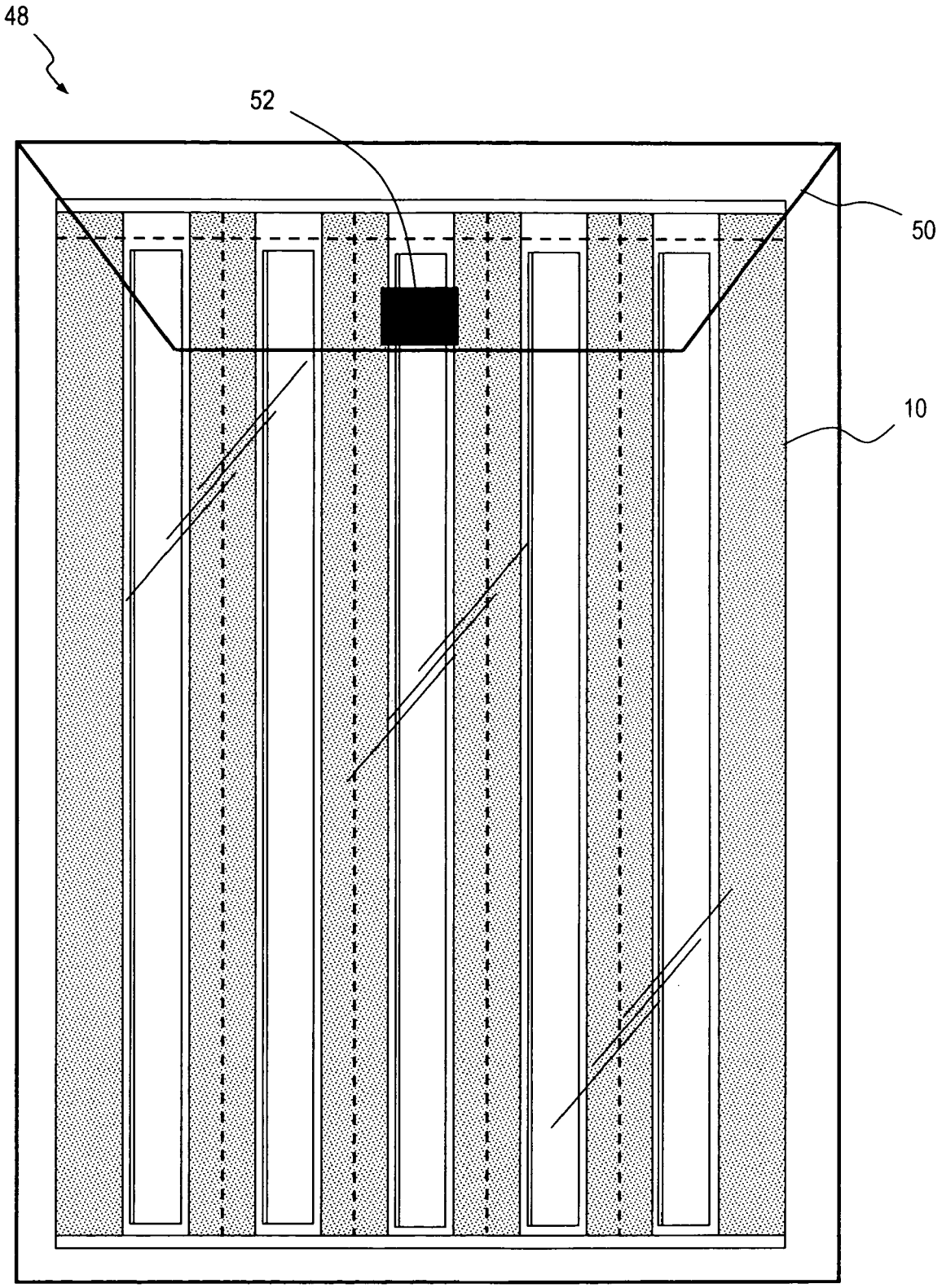
FIG. 8 shows an envelope for use with a flexible package, according to an embodiment of the present invention.

FIG. 8 depicts an envelope 48 that may be used with flexible package 10. Envelope 48 is sized to contain flexible package 10, and includes a releasable closure 50 having a fastener 52 to selectively secure the closure to the envelope. Envelope 48 provides additional protection for cutting blades 30 (FIG. 7) during storage and handling and may be used to store and handle used blades 30 for disposal or transport.

Envelope 48 may be made from any suitable material such as, for example, polypropylene, polyethylene and polyester and is preferably generally clear so that its contents may be viewed without the need to open it. Fastener 52 may be any conventional type of releasable fastener including, without limitation, snaps, clasps, adhesives and hook-and-loop.

While this invention has been shown and described with respect to a detailed embodiment thereof, it will be understood by those skilled in the art that changes in form and detail thereof may be made without departing from the scope of the claims of the invention. For example, the flexible packaging described herein may be utilized to contain objects other than cutting blades. Examples include, without limitation, hardware, commercial goods and food products.

What is claimed is:

1. A flexible package, comprising:

a first flexible layer having a first substrate with a first group of longitudinal spaced-apart adhesive strips disposed thereupon, the adhesive strips extending between opposing edges of the first substrate;

a second flexible layer having a second substrate with a second group of longitudinal spaced-apart adhesive strips disposed thereupon, the adhesive strips extending between opposing edges of the second substrate, the second group of adhesive strips being generally aligned with and joined to the first group of adhesive strips to form a plurality of generally monolithic longitudinal spaced-apart seal strips extending between a first package edge defined by the joined first and second package layers and a second, opposing package edge defined by the joined first and second package layers;

a plurality of longitudinal spaced-apart, adhesive-free voids formed by the first and second layers intermediate the seal strips, the voids extending between the first and second package edges and configured to receive objects to be contained by the package;

a first transverse heat seal formed along the first package edge;

a second transverse heat seal formed along the second package edge;

at least one series of longitudinal perforations bisecting at least one of said seal strips; and at least one series of transverse perforations oriented generally parallel to and proximate one of the first and second heat seals, wherein one or more objects are detachably and releasably contained by the package, each object being slidably disposed within the voids.

2. The flexible package of claim 1 wherein the first and second substrates are made from one of polypropylene, polyethylene and polyester.

3. The flexible package of claim 2 wherein the first and second substrates are made from low density polyethylene.

4. The flexible package of claim 1 wherein the first and second flexible layers are one of generally clear and opaque.

5. The flexible package of claim 1 wherein the adhesive is a cold seal cohesive material.

6. The flexible package of claim 5 wherein the cohesive material is an aqueous-based acrylic.

7. The flexible package of claim 6 wherein the cohesive material is in the range of about 0.0003 to 0.001 inches thickness.

8. The flexible package of claim 1 wherein the first and second groups of spaced-apart adhesive strips are applied by at least one of screen printing, spraying, blade coating and roll-coating.

9. The flexible package of claim 1 wherein the objects are cutting blades.

10. The flexible package of claim 1 wherein the first and second layers are cut to a predetermined length from a continuous roll.

11. The flexible package of claim 1, further comprising an envelope for containing the flexible package.

12. A flexible package for cutting blades, comprising:

a first flexible layer having a first, opaque low density polyethylene substrate with a first group of longitudinal spaced-apart cold seal cohesive strips disposed thereupon, the adhesive strips extending between opposing edges of the first substrate;

a second flexible layer having a second, generally clear low density polyethylene substrate with a second group of longitudinal spaced-apart cold seal cohesive strips disposed thereupon, the adhesive strips extending between opposing edges of the second substrate, the second group of cohesive strips being generally aligned with and joined to the first group of cohesive strips to form a plurality of generally monolithic longitudinal spaced-apart seal strips extending between a first package edge defined by the joined first and second package layers and a second, opposing package edge defined by the joined first and second package layers;

a plurality of longitudinal spaced-apart, adhesive-free voids formed by the first and second layers intermediate the seal strips, the voids extending between the first and second package edges and configured to receive cutting blades to be contained by the package;

a first transverse heat seal formed along the first package edge;

a second transverse heat seal formed along the second package edge;

at least one series of longitudinal perforations bisecting at least one of said seal strips; and at least one series of transverse perforations oriented generally parallel to and proximate one of the first and second heat seals, wherein one or more cutting blades are detachably and releasably contained by the package, each cutting blade being slidably disposed within the voids.

13. The flexible package of claim 12, further comprising an envelope for containing the flexible package, the envelope being made of a plastic material and including a releasable closure with a fastener to selectably secure the closure to the envelope.

14. A method for packaging objects, comprising the steps of:

applying a first group of longitudinal spaced-apart adhesive strips to a first substrate to form a first flexible layer, the adhesive strips extending between opposing edges of the first substrate;

applying a second group of longitudinal spaced-apart adhesive strips to a second substrate to form a second flexible layer, the adhesive strips extending between opposing edges of the second substrate;

placing objects to be packaged upon the first substrate, between the first group of spaced-apart adhesive strips;

aligning the first and second groups of spaced-apart adhesive strips with each other and joining them together to form a plurality of generally monolithic longitudinal spaced-apart seal strips extending between a first package edge defined by the joined first and second package layers and a second, opposing package edge defined by the joined first and second package layers, such that a plurality of longitudinal spaced-apart, adhesive-free voids are formed by the first and second layers intermediate the seal strips, the voids extending between the first and second package edges and configured to contain the objects;

forming a first transverse heat seal along the first package edge;

forming a second transverse heat seal along the second package edge;

bisecting at least one of said seal strips with a series of longitudinal perforations; and making at least one series of transverse perforations oriented generally parallel to and proximate one of the first and second heat seals, wherein the objects are detachably and releasably contained by the package, each object being slidably disposed within the voids.

15. The method of claim 14, further comprising the step of selecting one of polypropylene, polyethylene and polyester for the first and second substrates.

16. The method of claim 14, further comprising the step of selecting one of generally clear and opaque materials for the first and second flexible layers.

17. The method of claim 14, further comprising the step of selecting a cold seal cohesive material for the first and second groups of adhesive strips.

18. The method of claim 14, further comprising the step of applying the first and second groups of spaced-apart adhesive strips by at least one of screen printing, spraying, blade coating and roll-coating.

19. The method of claim 14, further comprising the step of selecting cutting blades for the objects to be packaged.

20. The method of claim 14, further comprising the step of cutting the first and second layers to a predetermined length from a continuous roll.

21. The method of claim 14, further comprising the step of containing the packaged objects in a plastic envelope having a closure and a fastener for selectively securing the closure to the envelope.

22. A flexible package produced according to the method of claim 14.

* * * * *